US007163204B1

(12) United States Patent
Liao

(10) Patent No.: US 7,163,204 B1
(45) Date of Patent: Jan. 16, 2007

(54) DART AND DARTBOARD SET

(75) Inventor: Been-Tzaw Liao, Taichung Hsien (TW)

(73) Assignee: Guten Electronics Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 11/253,953

(22) Filed: Oct. 18, 2005

(51) Int. Cl.
*F41J 3/00* (2006.01)
*F41J 5/00* (2006.01)

(52) U.S. Cl. ..... 273/348.3; 273/371

(58) Field of Classification Search ..... 273/348.3, 273/371–377, 403, 404, 407, 408
See application file for complete search history.

(56) References Cited

U.S. PATENT DOCUMENTS 2,863,665 A * 12/1958 Gerosolina ..... 273/348.3
3,836,148 A * 9/1974 Manning ..... 273/368
5,318,319 A * 6/1994 Jones et al. ..... 273/371
5,775,694 A * 7/1998 Jonsson ..... 273/348.3
6,062,997 A * 5/2000 Seymour ..... 473/578
6,155,570 A * 12/2000 Allison et al. ..... 273/373
6,860,482 B1 * 3/2005 Kim ..... 273/348.3
2002/0070501 A1 * 6/2002 Shao ..... 273/371
2003/0034612 A1 * 2/2003 Yoon ..... 273/348.3
2005/0167926 A1 * 8/2005 Shaw et al. ..... 273/408

FOREIGN PATENT DOCUMENTS

GB 2086243 A * 5/1982
GB 2342053 A * 4/2000
WO WO 9521660 A1 * 8/1995

* cited by examiner

*Primary Examiner*—Mark S. Graham
(74) *Attorney, Agent, or Firm*—Charles E. Baxley

(57) ABSTRACT

A dart and dartboard set, which includes a dart, which is a plastic dart with a flat magnet at the front end, and a dartboard, includes a front fabric panel printed with a score, ring pattern, a back fabric panel, two induction circuit membranes separated by a flexible magnet panel and packed between the front fabric panel and the back fabric panel, and a control circuit board for counting and displaying the score.

10 Claims, 7 Drawing Sheets

DART AND DARTBOARD SET

BACKGROUND OF THE INVENTION

1. Field of the Invention

The present invention relates to darts and more particularly, to a dart and dartboard set for the game of darts that is safe in use and convenient to carry.

2. Description of the Related Art

A regular electronic dartboard, as shown in FIG. 1, is comprised a base frame 10, a rim 11, a dartboard body 12, a plurality of dartboard blocks 13, an induction wheel 14, and a back frame 15. The dartboard body 12 is a meshed structure having open spaces for accommodating the dartboard blocks 13. When the player threw the dart 16 (see FIG. 2) at one dartboard block 13, the respective dartboard block 13 is moved relative to the dartboard body 12 to touch the induction wheel 14, causing the induction wheel 14 to induce a signal and to send the induced signal to a control circuit board (not shown) for counting the score for enabling the counted score to be shown on the display screen 17 at the base frame 10.

The aforesaid dart 16 is not safe in use. Because the dart 16 has a point 161 for piercing the dartboard blocks 13, the point 161 may injure the player accidentally. Further, the aforesaid dartboard is not easy to manufacture and assemble because of its complicated structure. The high thickness of this structure of dartboard makes the dartboard not convenient to carry.

SUMMARY OF THE INVENTION

The present invention has been accomplished under the circumstances in view. It is therefore the main object of the present invention to provide dart and dartboard set, which is safe in use and convenient to carry. It is another object of the present invention to provide a dart and dartboard set, which is amusing and provides various scoring modes for selection.

To achieve these and other objects of the present invention, the dart and dartboard set comprises a magnetic dartboard and a number of magnetic darts for throwing at the magnetic dartboard for scoring. The magnetic dartboard comprises a face fabric panel, the face fabric panel having a score ring pattern printed thereon; a back fabric panel; a flexible magnetic panel sandwiched between the face fabric panel and the back fabric panel; a first induction circuit membrane sandwiched between the face fabric panel and the flexible magnetic panel, the first induction circuit membrane having a plurality of induction zones corresponding to the score ring pattern of the face fabric panel, an output connector, and a plurality of lead wires respectively extending from the induction zones of the first induction circuit membrane to the output connector of the first induction circuit membrane; a second induction circuit membrane sandwiched between the flexible magnetic panel and the back fabric panel, the second induction circuit membrane having a plurality of induction zones corresponding to the score ring pattern of the face fabric panel, an output connector, and a plurality of lead wires respectively extending from the induction zones of the second induction circuit membrane to the output connector of the second induction circuit membrane; a frame structure that holds the face fabric panel, the first induction circuit membrane, the flexible magnetic panel, the second induction circuit membrane and the back fabric panel together; and a control circuit assembly provided at a bottom side and electrically connected with the output connector of the first induction circuit membrane and the output connector of the second induction circuit membrane for counting and displaying the score obtained during the game.

DETAILED DESCRIPTION OF THE PREFERRED EMBODIMENT

Figure 1:
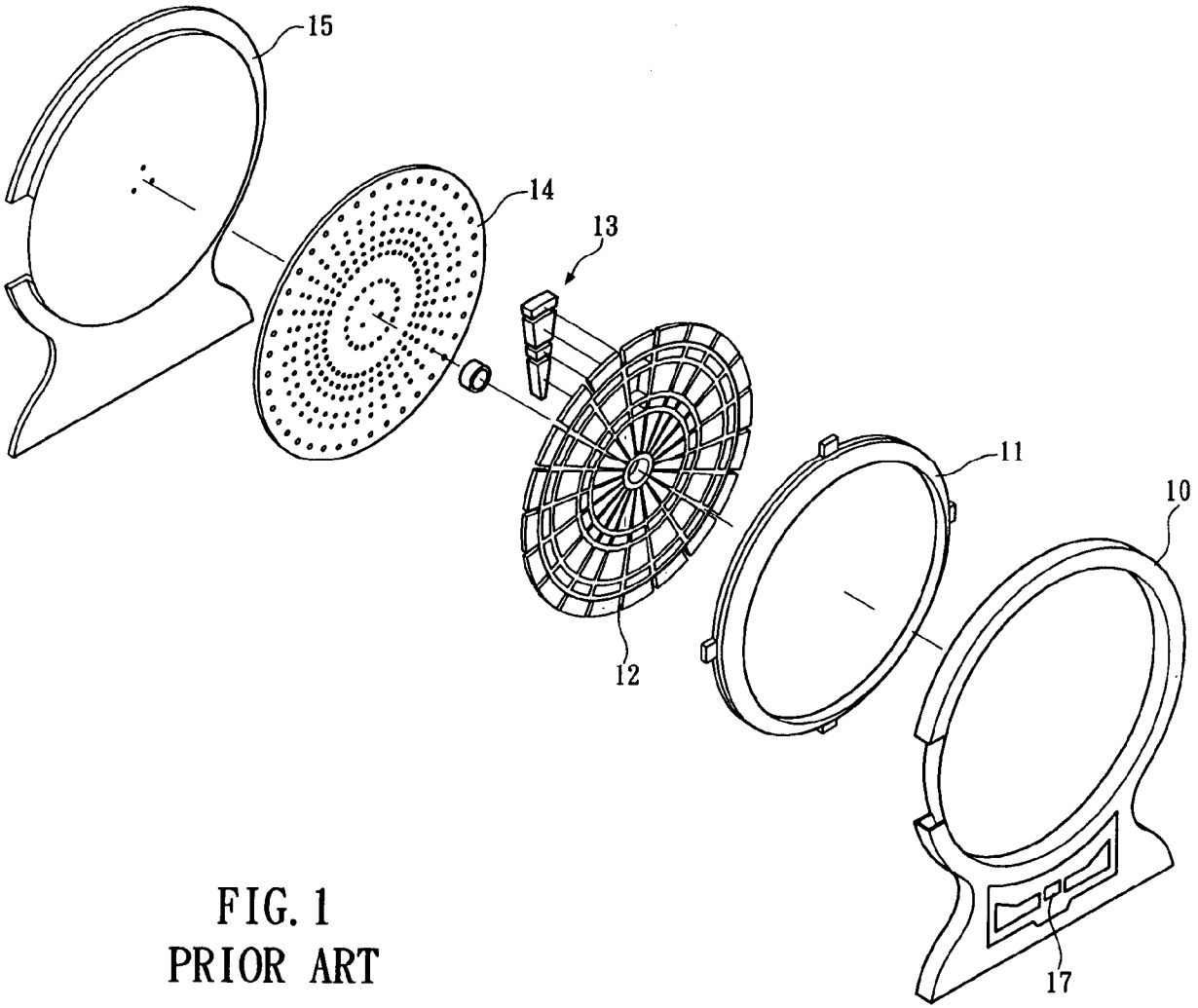
FIG. 1 PRIOR ART
FIG. 1 is an exploded view of a dartboard according to the prior art.
Figure 2:
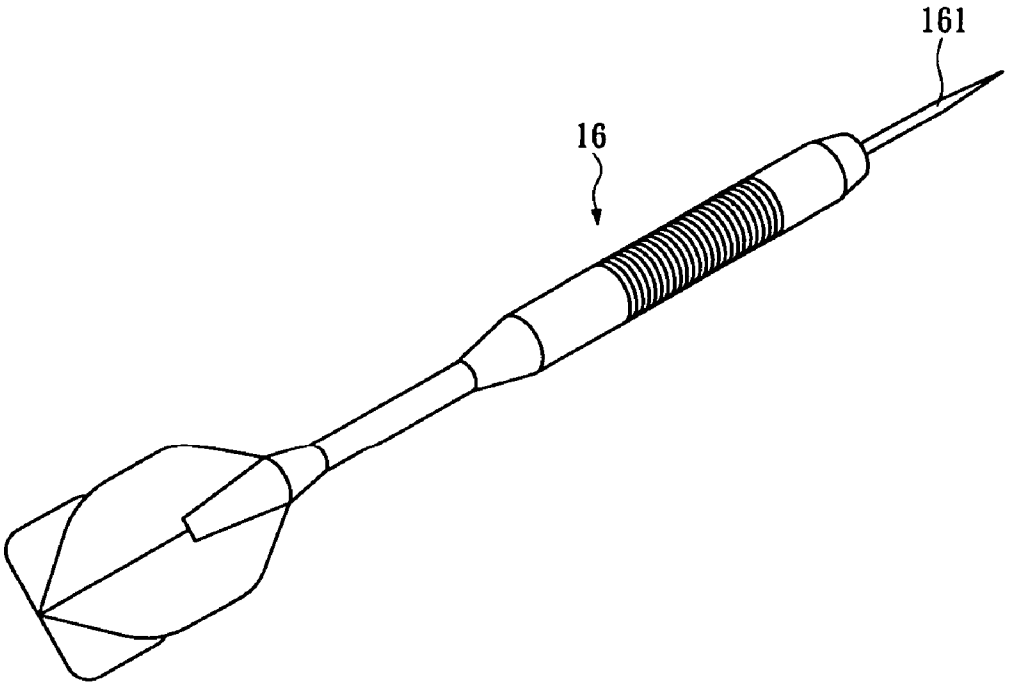
FIG. 2 PRIOR ART
FIG. 2 is an elevational view of a dart according to the prior art.
Figure 3:
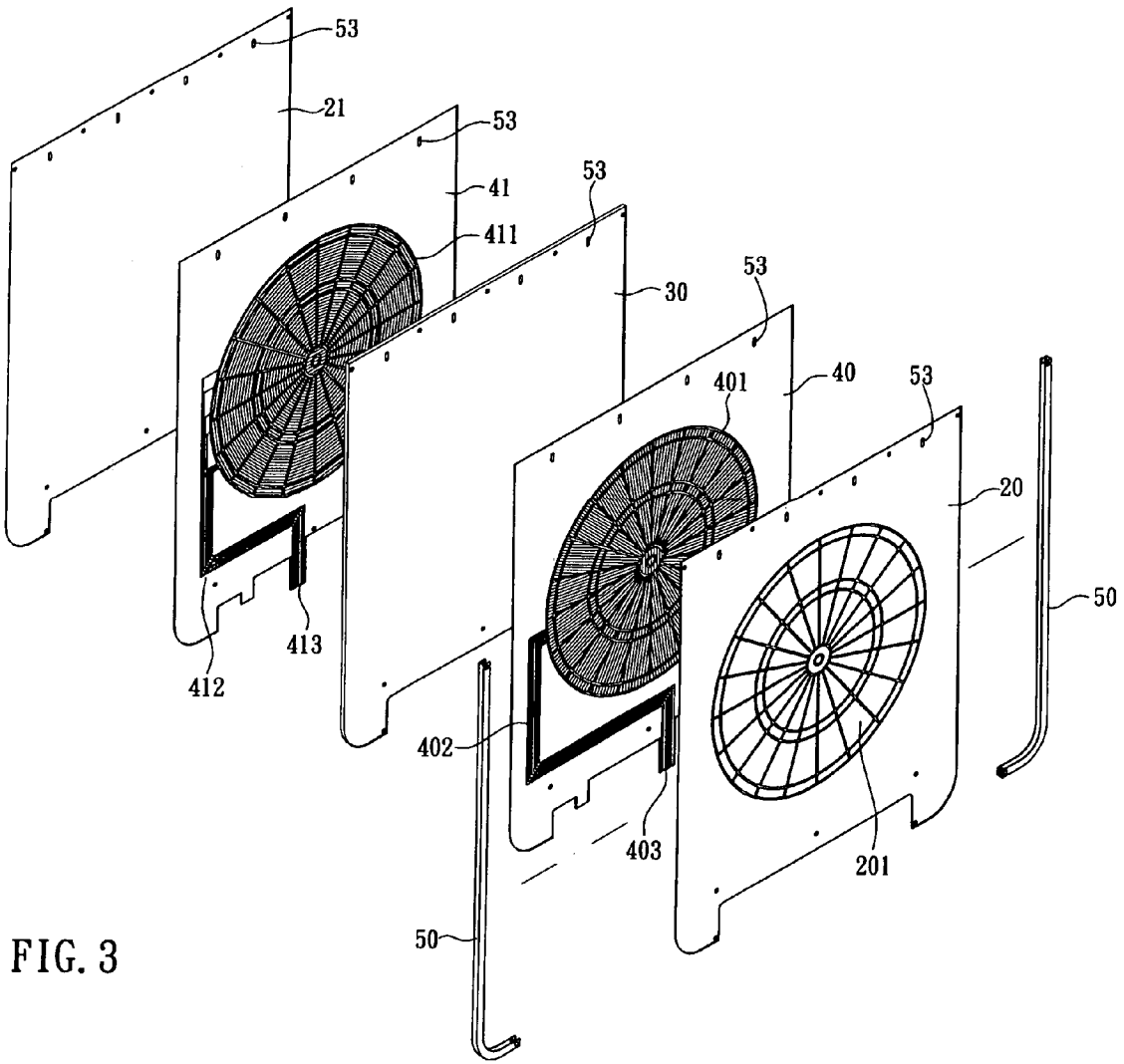
FIG. 3 is an exploded view of a dartboard according to the present invention.
Figure 4:
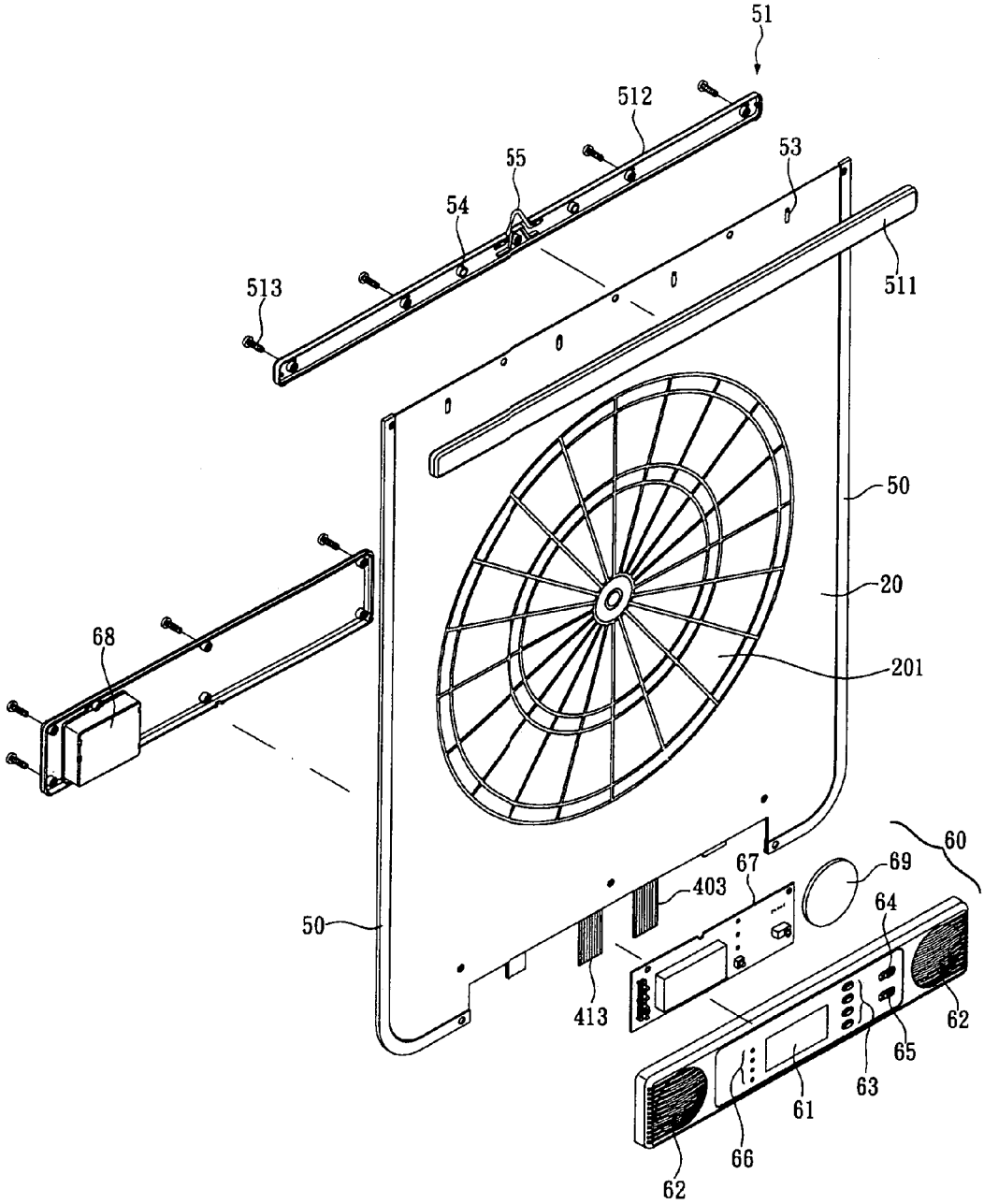
FIG. 4 is another exploded view of the dartboard according to the present invention.
Figure 5:
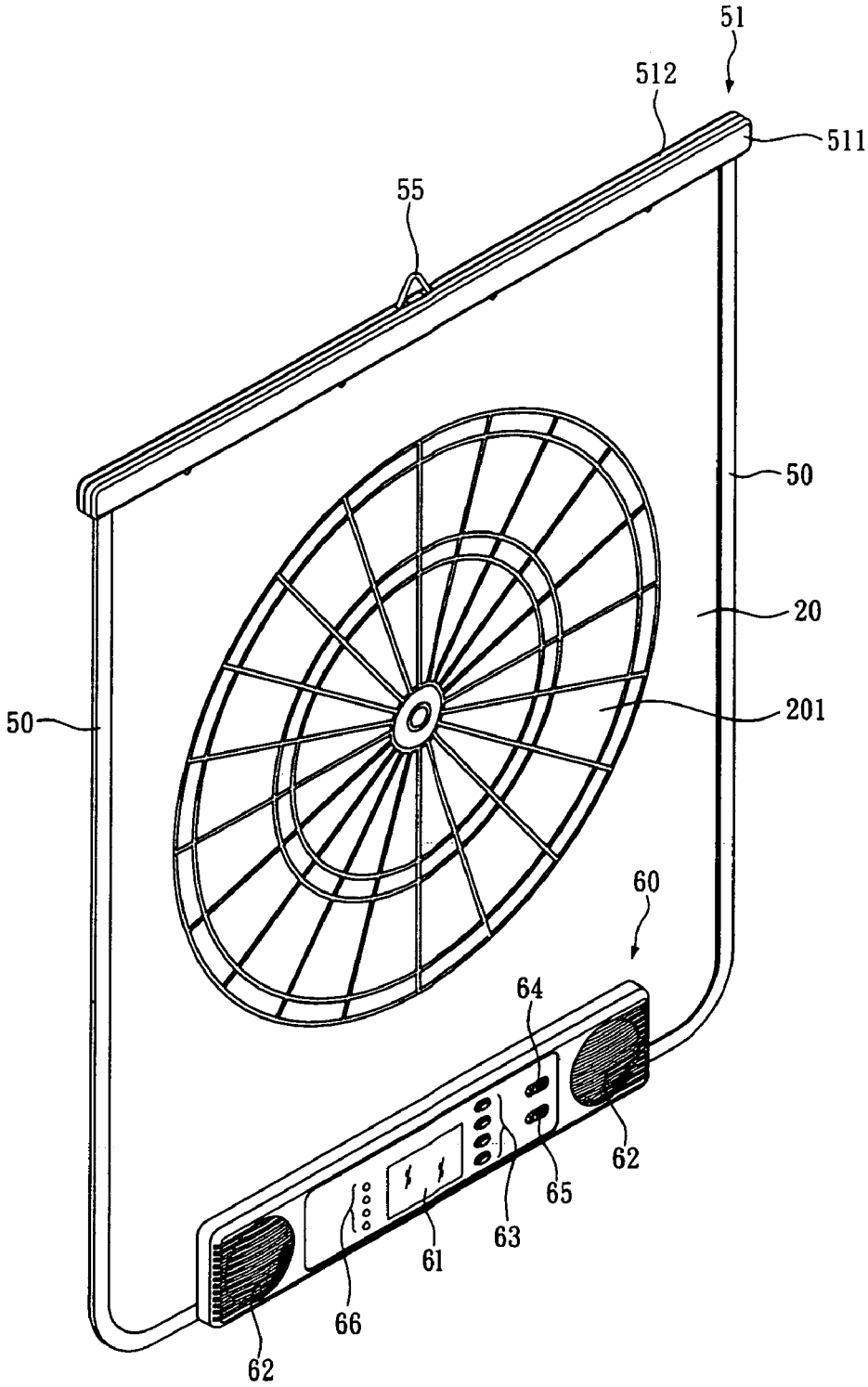
FIG. 5 is an elevational assembly view of the dartboard according to the present invention.

Referring to FIGS. 3~5, a dart and dartboard set in accordance with the present invention is comprised of a magnetic dartboard and a number of darts The dartboard according to the present invention comprises a face fabric panel 20, which has a score ring pattern 201 printed thereon, a back fabric panel 21, a flexible magnetic panel 30 sandwiched between the face fabric panel 20 and the back fabric panel 21, a first induction circuit membrane 40, which is sandwiched between the face fabric panel 20 and the flexible magnetic panel 30, having a plurality of induction zones 401 corresponding to the score ring pattern 201 of the face fabric panel 20, an output connector 403, and a plurality of lead wires 402 respectively extending from the induction zones 401 to the output connector 403, a second induction circuit membrane 41, which is sandwiched between the flexible magnetic panel 30 and the back fabric panel 21, having a plurality of induction zones 411 corresponding to the score ring pattern 201 of the face fabric panel 20, an output connector 413, and a plurality of lead wires 412 respectively extending from the induction zones 411 to the output connector 413.

The magnetic dartboard further comprises a frame structure that holds the face fabric panel 20, the first induction circuit membrane 40, the flexible magnetic panel 30, the second induction circuit membrane 41 and the back fabric panel 21 together, and a control circuit assembly 60. The frame structure comprises two fabric packing strips 50 fastened to the left, right and bottom sides of the stacked structure of the face fabric panel 20, the first induction circuit membrane 40, the flexible magnetic panel 30, the second induction circuit membrane 41 and the back fabric panel 21 with stitches, and a clip 51 fastened to the top side of the stacked structure of the face fabric panel 20, the first induction circuit membrane 40, the flexible magnetic panel 30, the second induction circuit membrane 41 and the back fabric panel 21. The clip 51 is comprised of two elongated clamping strips 511 and 512. The two clamping strips 511 and 512 are respectively attached to the face fabric panel 20 and the back fabric panel 21 at the top and fastened together with screws 513 to hold the stacked structure of the face fabric panel 20, the first induction circuit membrane 40, the flexible magnetic panel 30, the second induction circuit membrane 41 and the back fabric panel 21. One clamping strip 512 has a plurality of studs 54 respectively inserted through respective through holes 53 on the stacked structure of the face fabric panel 20, the first induction circuit membrane 40, the flexible magnetic panel 30, the second induction circuit membrane 41 and the back fabric panel 21 and connected to the other clamping strip 511. Further, the clip 51 is provided with a hanging ring 55 for hanging on a wall nail.

The aforesaid control circuit assembly 60 is fastened to the bottom side of the stacked structure of the face fabric panel 20, the first induction circuit membrane 40, the flexible magnetic panel 30, the second induction circuit membrane 41 and the back fabric panel 21, comprising a display screen 61, two sound effect output devices, i.e., speakers 62, selector buttons 63, a power switch 64, a sound effect switch 65, indicator lights 66, a control circuit board 67, a power supply device 68, and a buzzer 69. The output connectors 403 and 413 of the induction circuit membranes 40 and 41 are respectively electrically connected to the control circuit board 67 for signal output to the control circuit board 67. The selector buttons 63 are for selection of games and scoring modes preset in the control circuit board 67. After selection of the desired game, the control circuit board 67 drives the display screen 61 to display the selected game mode and the buzzer 69 to output a predetermined music through the speakers 62. When the game is started, the indicator lights 66 are alternatively turned on in proper order subject to the order of the players. The power switch 64 controls on/off status of the control circuit assembly 60. The sound effect switch controls on/off of the preset sound effect (music). When a score is obtained during play of the game, the control circuit board 67 drives the display screen 61 to display the corresponding score.

Figure 6:
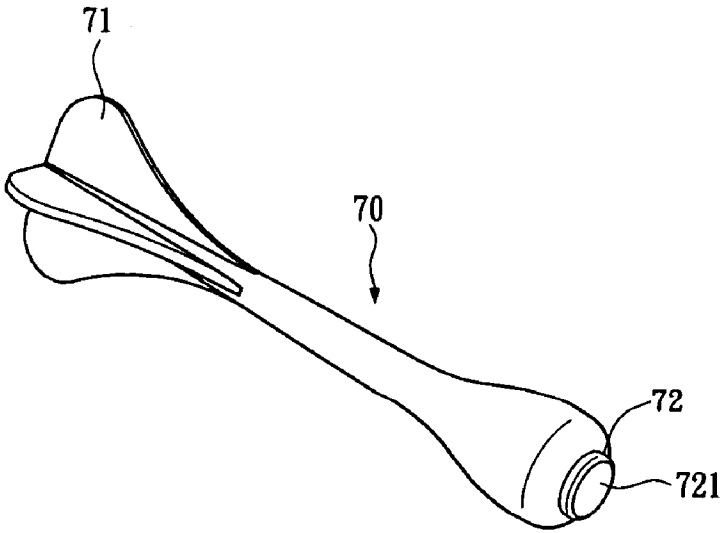
FIG. 6 is an elevational view of a dart according to the present invention.

Referring to FIG. 6, the dart 70 is molded from plastics, having a front end fixedly mounted with a magnet 72 and a rear end terminating in a flight 71. The magnet 72 is a flat magnet, having a flat front face 721.

Figure 8:
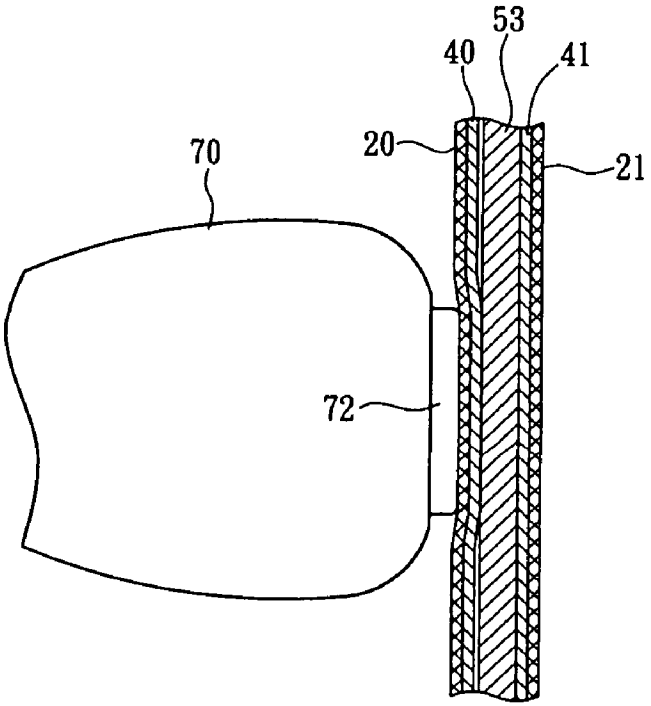
FIG. 8 is a sectional view in an enlarged scale of a part of FIG. 7.
Figure 7:
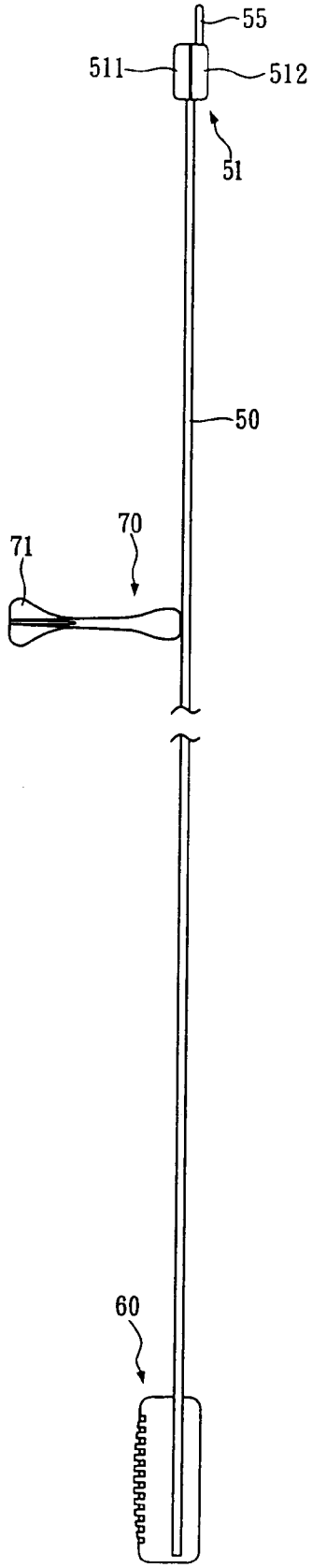
FIG. 7 is a schematic drawing showing the dart attracted by the dartboard according to the present invention.

Referring to FIGS. 7 and 8, when the player throwing the dart 70 toward the magnetic dartboard, the magnetic attractive force of the flexible magnetic panel 30 attracts the magnet 72 of the dart 70. Subject to the hit location of the dart 70, the respective induction zones 401 and 411 of the induction circuit membranes 40 and 41 are induced to output a corresponding signal to the control circuit board 67, which counts the score subject to the resistance value of the induced signal and drives the display screen 61 to display the score.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. A dart and dartboard set comprising a magnetic dartboard and a number of magnetic darts for throwing at said magnetic dartboard for scoring, wherein said magnetic dartboard comprises a face fabric panel, said face fabric panel having a score ring pattern printed thereon;

a back fabric panel;

a flexible magnetic panel sandwiched between said face fabric panel and said back fabric panel;

a first induction circuit membrane sandwiched between said face fabric panel and said flexible magnetic panel, said first induction circuit membrane having a plurality of induction zones corresponding to the score ring pattern of said face fabric panel, an output connector, and a plurality of lead wires respectively extending from the induction zones of said first induction circuit membrane to the output connector of said first induction circuit membrane;

a second induction circuit membrane sandwiched between said flexible magnetic panel and said back fabric panel, said second induction circuit membrane having a plurality of induction zones corresponding to the score ring pattern of said face fabric panel, an output connector, and a plurality of lead wires respectively extending from the induction zones of said second induction circuit membrane to the output connector of said second induction circuit membrane;

a frame structure that holds said face fabric panel, said first induction circuit membrane, said flexible magnetic panel, said second induction circuit membrane and said back fabric panel together; and a control circuit assembly provided at a bottom side and electrically connected with the output connector of said first induction circuit membrane and the output connector of said second induction circuit membrane for counting and displaying the score obtained during the game.

2. The dart and dartboard set as claimed in claim 1, wherein said control circuit assembly comprises a control circuit board, a power switch electrically connected to said control circuit board for power on/off control, a plurality of selector buttons electrically connected to said control circuit board for selection of score counting modes, and a display screen electrically connected to said control circuit board for displaying the score obtained during the game and the score counting mode selected.

3. The dart and dartboard set as claimed in claim 2, wherein said control circuit assembly further comprises a buzzer and a sound effect output means for output of a sound effect.

4. The dart and dartboard set as claimed in claim 3, wherein said control circuit assembly further comprises a sound effect switch electrically connected to said control circuit board and adapted to control said control circuit board to drive said buzzer and said sound effect output means to output a sound effect.

5. The dart and dartboard set as claimed in claim 2, wherein said control circuit board further comprises a plurality of indicator lights controlled by said control circuit board to indicate the number and order of players.

6. The dart and dartboard set as claimed in claim 1, wherein said magnetic darts each have a front end fixedly mounted with a flat magnet, said flat magnet having a flat front face.

7. The dart and dartboard set as claimed in claim 1, wherein said frame structure comprises two fabric packing strips fastened to left, right and bottom sides of said face fabric panel, said first induction circuit membrane, said flexible magnetic panel, said second induction circuit membrane and said back fabric panel with stitches, and a clip fastened to a top side of said face fabric panel, said first induction circuit membrane, said flexible magnetic panel, said second induction circuit membrane and said back fabric panel.

8. The dart and dartboard set as claimed in claim 7, wherein said clip is comprised of two elongated clamping strips respectively attached to said face fabric panel and said back fabric panel and fastened together with fastening elements.

9. The dart and dartboard set as claimed in claim 8, wherein one of said two elongated clamping strips has a plurality of studs respectively inserted through respective through holes on said face fabric panel, said first induction circuit membrane, said flexible magnetic panel, said second induction circuit membrane and said back fabric panel and connected to the other of said two elongated clamping strips.

10. The dart and dartboard set as claimed in claim 7, wherein said clip has a hanging ring for hanging.

* * * * *